US006283704B1

(12) United States Patent
Yoshioka

(10) Patent No.: US 6,283,704 B1
(45) Date of Patent: Sep. 4, 2001

(54) CIRCUMFERENTIAL FLOW TYPE LIQUID PUMP

(75) Inventor: Hiroshi Yoshioka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/445,811

(22) PCT Filed: Apr. 14, 1998

(86) PCT No.: PCT/JP98/01699

§ 371 Date: Jan. 28, 2000

§ 102(e) Date: Jan. 28, 2000

(87) PCT Pub. No.: WO99/53203

PCT Pub. Date: Oct. 21, 1999

(51) Int. Cl.[7] ..... F04D 5/00
(52) U.S. Cl. ..... 415/55.1; 415/169.1
(58) Field of Search ..... 415/55.1, 55.2, 415/55.3, 55.4, 55.5, 55.6, 55.7, 169.1

(56) References Cited

U.S. PATENT DOCUMENTS

| | | | | |
|---|---|---|---|---|
| 4,793,766 | * | 12/1988 | Kumata | 415/55.1 |
| 5,192,184 | * | 3/1993 | Nobuo et al. | 415/169.1 |
| 5,221,178 | | 6/1993 | Yoshioka et al. . | |
| 5,338,151 | * | 8/1994 | Kemmner et al. | 415/55.1 |
| 5,375,970 | * | 12/1994 | Iwai et al. | 415/55.1 |
| 5,586,858 | * | 12/1996 | Tuckey | 415/55.1 |

FOREIGN PATENT DOCUMENTS

| | | | | |
|---|---|---|---|---|
| 60-138297 | * | 7/1985 | (JP) | 415/55.1 |
| 63-223388 | | 9/1988 | (JP) . | |
| 63-160387 | | 10/1988 | (JP) . | |
| 63-164592 | | 10/1988 | (JP) . | |
| 4-31660 | * | 2/1992 | (JP) | 415/55.1 |
| 5-19556 | | 3/1993 | (JP) . | |
| 6-173881 | | 6/1994 | (JP) . | |

* cited by examiner

*Primary Examiner*—Christopher Verdier
(74) *Attorney, Agent, or Firm*—Sughrue, Mion, Zinn, Macpeak & Seas, PLLC

(57) ABSTRACT

A circumferential flow liquid pump having formed in the vicinity of an impeller 4 an inner circumferential portion of a pump flow path 7 an air vent passage 31 having an opening with a step from a bottom portion 10 of the pump flow path 7 and extending in the radially inward direction and a through hole 32 for connecting the air vent passage 31 and the exterior of the pump casing assembly 1 together, having a sufficiently large cross-sectional area as compared to the air vent passage 31 and a cross-sectional configuration of a partial annular ring shape extending along the pump flow path 7. The through hole may be a plurality of passages 33 disposed within the region of the partial annular ring shape or al passage 34 directly connected to the pump flow path 7 without having the air vent passage 31 interposed therebetween.

8 Claims, 8 Drawing Sheets

CIRCUMFERENTIAL FLOW TYPE LIQUID PUMP

TECHNICAL FIELD

This invention relates to a circumferential flow liquid pump and, more particularly, to a circumferential flow liquid pump for use in a vehicular internal combustion engine as a fuel pump for pumping a liquid fuel such as gasoline from a fuel tank.

BACKGROUND ART

FIG. 7 is a longitudinal sectional view showing a conventional circumferential flow liquid pump disclosed in Japanese Patent Publication No. 7-3239, for example. FIG. 8 is an enlarged sectional view taken along line VII—VII of FIG. 7. FIG. 9 is an enlarged sectional view taken along line IX—IX of FIG. 8.

In the figures, 1 designates an assembly of a pump casing, the assembly being constituted with the pump casing main body 2 and the cover 3. Within the pump casing assembly 1, an impeller 4 having vane portion 5 at its outer circumferential edge is disposed, the impeller 4 being supported by a central shaft 6 so that it is rotatable about its central axis relative to the pump casing assembly 1.

The pump casing assembly 1, as shown in FIG. 8, defines a pump flow path 7 of an annular band shape extending along the outer circumferential edge of the impeller 4 and a suction port 8 and a discharge port 9 opening to the opposite end portions of the pump flow path 7, the pump casing assembly 1 also accommodating the vane portion 5 of the impeller 4 within the pump flow path 7. Describing the further details of the pump casing assembly 1, as shown in FIG. 9, an air vent passage 11 opening from the bottom portion 10 of the pump flow path 7 and extending radially with a step therebetween is provided in the vicinity of the impeller 4 of the inner circumferential portion of the pump flow path 7 of the cover 3, and a through hole 12 having a sufficiently larger cross sectional area as compared to that of the air vent passage 11 for communicating the air vent passage 11 to the exterior of the pump casing assembly.

The central shaft 6 of the impeller 4 is constructed as the central shaft of the electric motor 15 connected to the circumferential liquid pump and its opposite end portions are rotatably supported by a bearing 17 and a bearing 18. 19 is an end cover provided with a check valve 22 and the liquid outlet 23 and holding the bracket 24. The pump casing assembly 1 and the end cover 19 are connected together by a yoke 20 of the electric motor 15. The yoke 20 accommodates therein a rotor 16, defines a liquid chamber 21 between the pump casing assembly 1 and the end cover 19 for storing the liquid such as a liquid fuel discharged from the discharge port 9 and has assembled to its inner circumferential portion a permanent magnet 25 serving as a stator. The liquid chamber 21 is communicated with the liquid outlet 23 having the check valve 22 disposed to the end cover 19, and inserted within the bracket 24 is a power supplying brush 27 brought in a sliding contact with a commutator 26 of the rotor 16.

Then, the operation of the conventional circumferential flow liquid pump will be described.

Also, within the pump flow path 7, gas in the form of bubbles due to the evaporation of the fuel generates at the liquid contacting surface of the vane portion 5 and the impeller 4 and tends to flow out into the liquid chamber 21. If these bubbles of gas flow into the liquid chamber 21 and reaches the internal combustion engine, various troubles can happen. Therefor, the arrangement is such that the gas in the form of the bubbles is discharged out of the pump casing assembly 1 as much as possible by the air vent passage 11 open to the inner circumferential portion of the pump flow path 7 and the vicinity of the impeller 4 and the through hole 12.

This function will be described in more detail below. During the operation of the pump, the gas in the form of the bubbles of the fuel vapor, which is generated at the contacting surface between the liquid such as the fuel and the vane portion 5 of the impeller 4 within the pump flow path 7, is collected at the inner circumferential portion of the pump flow path 7 in the vicinity of the impeller 4 due to the centrifugal force and the difference in specific weight from the liquid fuel and flows together with the liquid through the pump flow path 7 clockwise as viewed in FIG. 8 or in the same direction as the direction of rotation of the impeller 4.

When the gas bubbles reach about the air vent passage 11 which opens at the inner circumferential portion of the pump flow path 7 in the vicinity of the impeller 4 with a step raised from the bottom portion 10 of the pump flow path 7 and which extends in the direction coinciding with the direction of whirling flow 13 generated by the impeller 4 within the pump flow path 7, then the gas collected in the vicinity of the impeller 4 due to the static pressure within the pump flow path 7 due to the pumping action and the dynamic pressure due to the whirling flow 13 generated by the impeller 4 within the pump flow path 7 is forced to be introduced into the air vent passage 11. The introduced gas is discharged out of the pump casing assembly 1 through the through hole 12 having a cross sectional area sufficiently larger than that of the air vent passage 11.

In the conventional circumferential liquid pump as above described, if the bubbles of the fuel vapor is generated within the pump flow path and accumulated within the pump flow path 7, the so-called vapor lock may generate, impeding the flow of the liquid fuel and significantly decreasing the pump discharge rate. In view of these problems, the conventional circumferential flow liquid pump is arranged to discharge the bubbles out of the pump casing assembly through the air vent passage 11 open to the inner circumferential portion of the pump flow path 7 and in the vicinity of the impeller 4 as well as the through hole 12.

With the above structure, the depth (H in FIG. 9) of the air vent passage 11 must be made small, and in order not to increase the flow path resistance against the gas flowing through the air vent passage 11, it is desirable that the length of the air vent passage 11 is as short as possible. However, since the cross section of the through hole 12 is circular and the cross section of the air vent passage 11 is flat, the side wall of the air vent passage 11 for communicating the pump flow path 7 and the through hole 12 together are inevitably long. Therefore, under a bad condition in which a lot of fuel vapor is generated, the gas in the form of bubbles of the fuel vapor may not sufficiently discharged outside of the pump casing assembly 1, leading to a fear that the generation of the vapor lock cannot completely be prevented.

This invention has been made to solve the above discussed problems and has as its object the provision of an improved circumferential flow liquid pump arranged such that the gas such as the fuel vapor bubbles generated within the pump flow path is ensured to be discharged from the pump flow path to the outside of the pump casing assembly and there is no fear that the vapor lock generates.

According to the present invention, the circumferential flow liquid pump comprises an impeller having a vane portion in an outer circumferential portion thereof, a pump casing assembly rotatably supporting the impeller and defining therein a pump flow path of an arcuate band-like shape extending along an outer circumferential portion of the impeller and an suction port and a discharge port open at the opposite end portions of the pump flow path, and an air vent hole defined in the pump casing assembly which opens at one end thereof in an inner circumferential portion of the pump flow path in the vicinity of the impeller and at a position radially inwardly spaced from the bottom portion of the pump flow path, opens at the other end thereof to the exterior of the pump casing assembly at a position radially inward of the opening at the one end and which has a cross-sectional configuration disposed within a region of a partial annular ring shape extending along the pump flow path and a sufficiently large cross-sectional area.

Also, the air vent hole may comprise a radial passage extending from the one end thereof in a radially inward direction and an axial passage connected at its one end to the other end of the radial passage and open at is the other end to the exterior of the pump casing assembly.

Also, the air vent hole may comprise a radial passage extending from the one end thereof in a radially inward direction and a plurality of axial passages each connected at its one end to the other end of the radial passage and open at its the other end to the exterior of the pump casing assembly and disposed within the region of a partial annular ring shape.

Further, the air vent hole m ay comprise an axial passage directly extending from the one end and opening at its the other end to the exterior of the pump casing assembly.

BEST MODE FOR CARRYING OUT THE INVENTION

Figure 1:
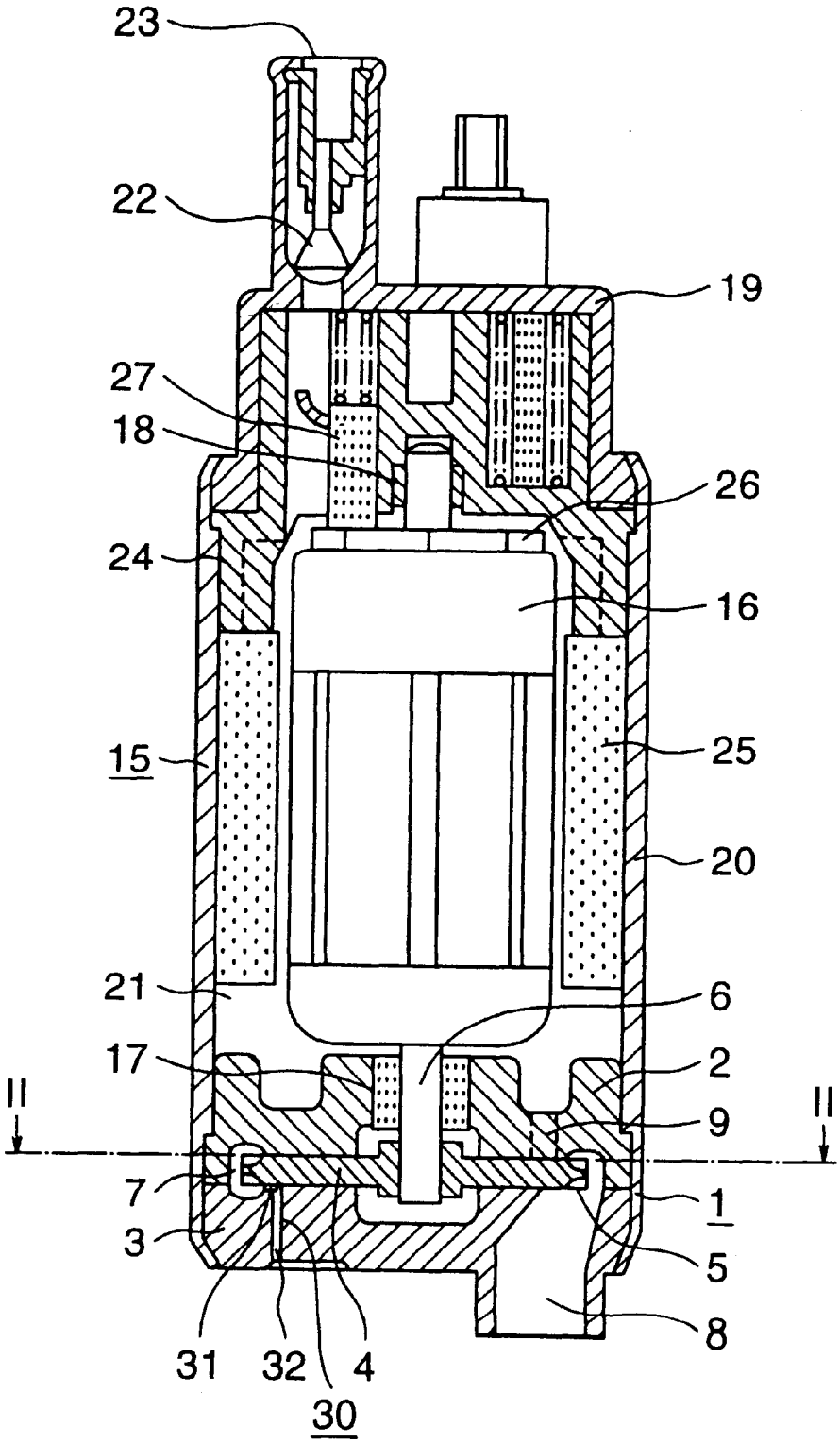
FIG. 1 is a longitudinal sectional,view of a circumferential liquid pump of the first embodiment of the present invention.
Figure 2:
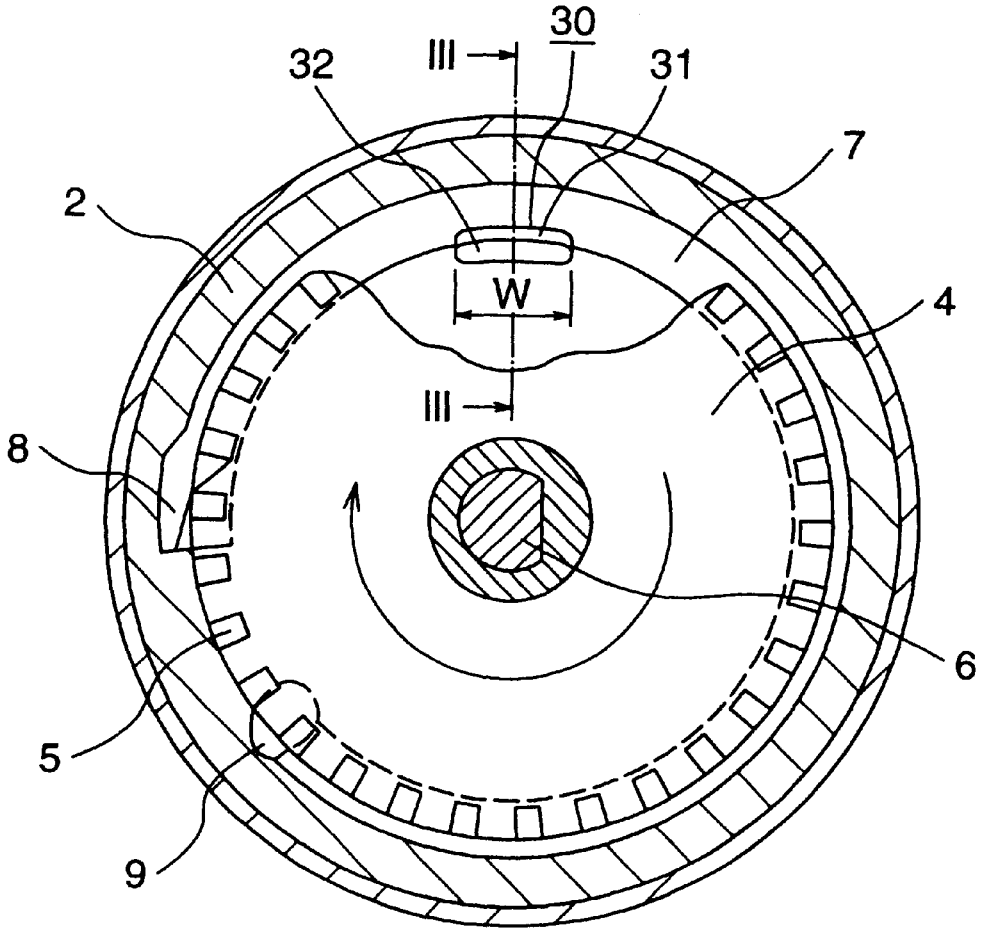
FIG. 2 is an enlarged sectional view taken along line II—II of FIG. 1.
Figure 3:
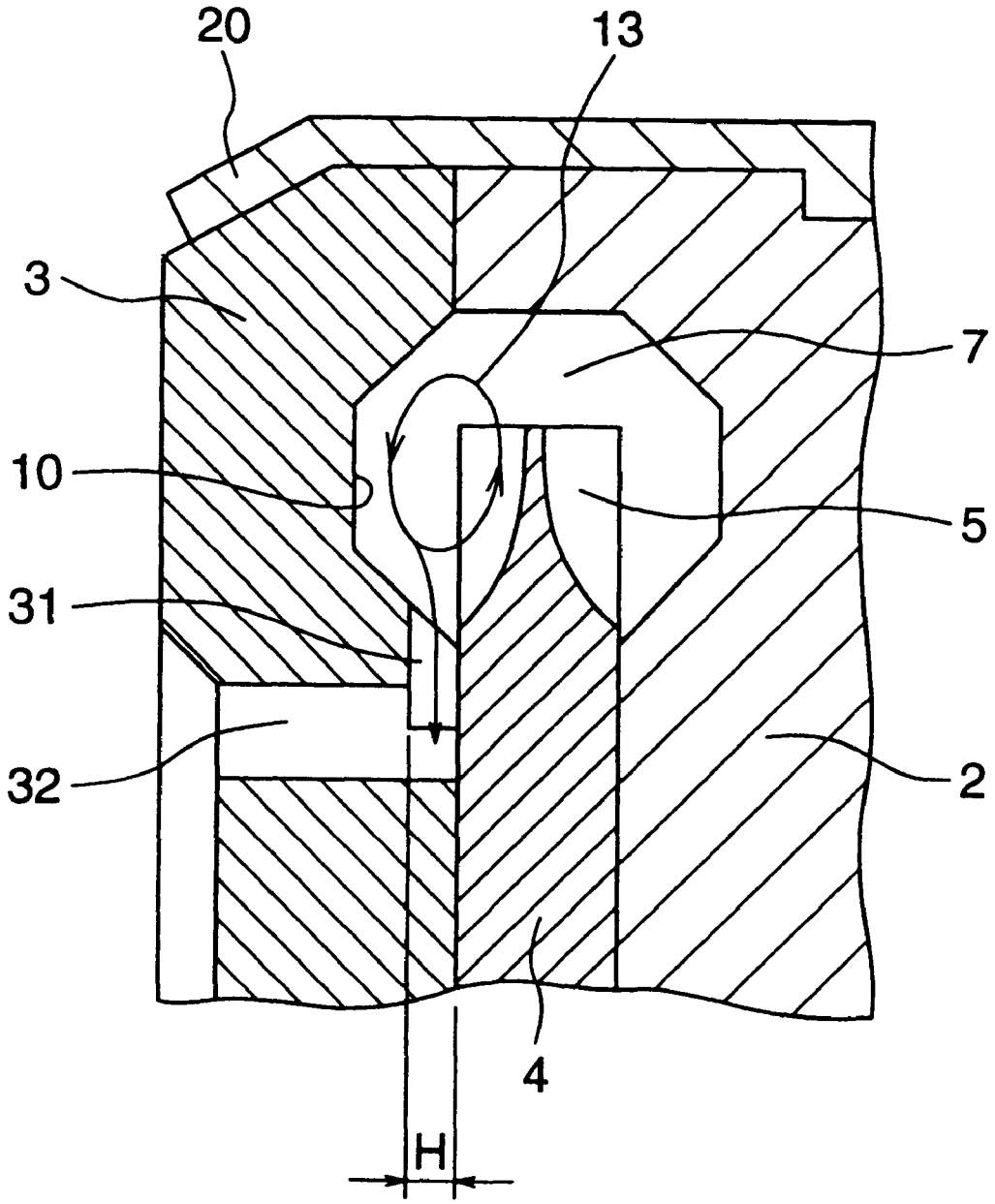
FIG. 3 is an enlarged sectional view taken along line III—III of FIG. 2.

FIG. 1 is a longitudinal sectional view of a circumferential liquid pump of the first embodiment of the present invention. FIG. 2 is an enlarged sectional view taken along line II—II of FIG. 1. FIG. 3 is an enlarged sectional view taken along line III—III of FIG. 2. In the FIGS. 1–10, 13, 15–27 are the components similar to those of the above-described conventional device, so that their explanation will be omitted.

In the figures, as shown in FIG. 3, the cover 3 of the pump casing assembly 1 has formed therein an air vent passage 31 (shown in FIG. 2) which opens in the vicinity of the impeller 4 in the inner circumferential portion of the pump flow path 7 with a raised step from the bottom portion 10 of the pump flow path 7 (a distance from the bottom portion 10 to the position spaced apart in the circumferentially inward and toward the impeller 4) and which extends in the radial direction, the cover 3 also has formed therein a through hole 32 having a sufficiently large cross-sectional area as compared to that of the air vent passage 31 for communicating the air vent passage 31 to the exterior of the pump casing assembly 1, which through hole 32 has an elongated circular shape extending along the pump flow path 7. The air vent passage 31 and the through hole 32 together constitute an air vent hole 30 which opens at one end thereof in an inner circumferential portion of the pump flow path 7 in the vicinity of the impeller 4 and at a position radially inwardly spaced from the bottom portion 10 of the pump flow path and which opens at the other end thereof to the exterior of the pump casing assembly 1 at a position radially inward of the opening at the one end. The cross-sectional configuration of this air vent hole 30 is within a region of a partial annular ring shape extending along the pump flow path and a sufficiently large cross-sectional area including the opening at one end in the pump flow path 7 as shown in FIG. 2.

The area of the cross section of the air vent passage 31 and the through hole 32 depends upon the pump size. For a typical passenger car, the air vent passage 31 has a rectangular cross-sectional shape having a width W (shown in FIG. 2) of 4 mm, a depth H (shown in FIG. 3) of 0.2 mm, for example, and the through hole has an elongated circular cross-sectional shape having a larger diameter of 4 mm and a shorter diameter of 1 mm, for example.

In the circumferential flow liquid pump having the above-described construction, the impeller 4 is driven by the electric motor 15 to be rotated in the clockwise direction as viewed in FIG. 2, whereby the liquid such as a liquid fuel is sucked from the suction port 8 at one end portion of the pump flow path 7. The sucked liquid flows through the pump flow path 7 in the clockwise direction as viewed in FIG. 2 and flows into the liquid chamber 21 from the discharge port 9 at its the other end.

During the operation of the pump, the gas in the form of the bubbles of the fuel vapor, which is generated at the contacting surface between the liquid such as the fuel and the vane portion 5 of the impeller 4 within the pump flow path 7, is collected at the inner circumferential portion of the pump flow path 7 in the vicinity of the impeller 4 due to the centrifugal force and the difference in specific weight from the liquid fuel and flows together with the liquid through the pump flow path 7 clockwise as viewed in FIG. 2 or in the same direction as the direction of rotation of the impeller 4.

When the gas bubbles reach about the air vent passage 31 which opens at the inner circumferential portion of the pump flow path 7 in the vicinity of the impeller 4 with a step raised from the bottom portion 10 of the pump flow path 7 and which extends in the direction coinciding with the direction of whirling flow 13 generated by the impeller 4 within the pump flow path 7, then the gas collected in the vicinity of the impeller 4 due to the static pressure within the pump flow path 7 due to the pumping action and the dynamic pressure due to the whirling flow 13 generated by the impeller 4 within the pump flow path 7 is forced to be introduced into the air vent passage 31.

The introduced gas is discharged out of the pump casing assembly 1 through the through hole 32 communicated with the air vent passage 31 and having a cross sectional area sufficiently larger than that of the air vent passage 31. It is to be noted that since the through hole 32 is arranged to be in an elongated circular configuration extending along the aforementioned pump flow path 7, the through hole 32 can be positioned close to the pump flow path 7 which makes the air vent passage 31 short, whereby the flow path resistance against the gas upon its passage through the air vent passage can be significantly decreased.

Figure 4:
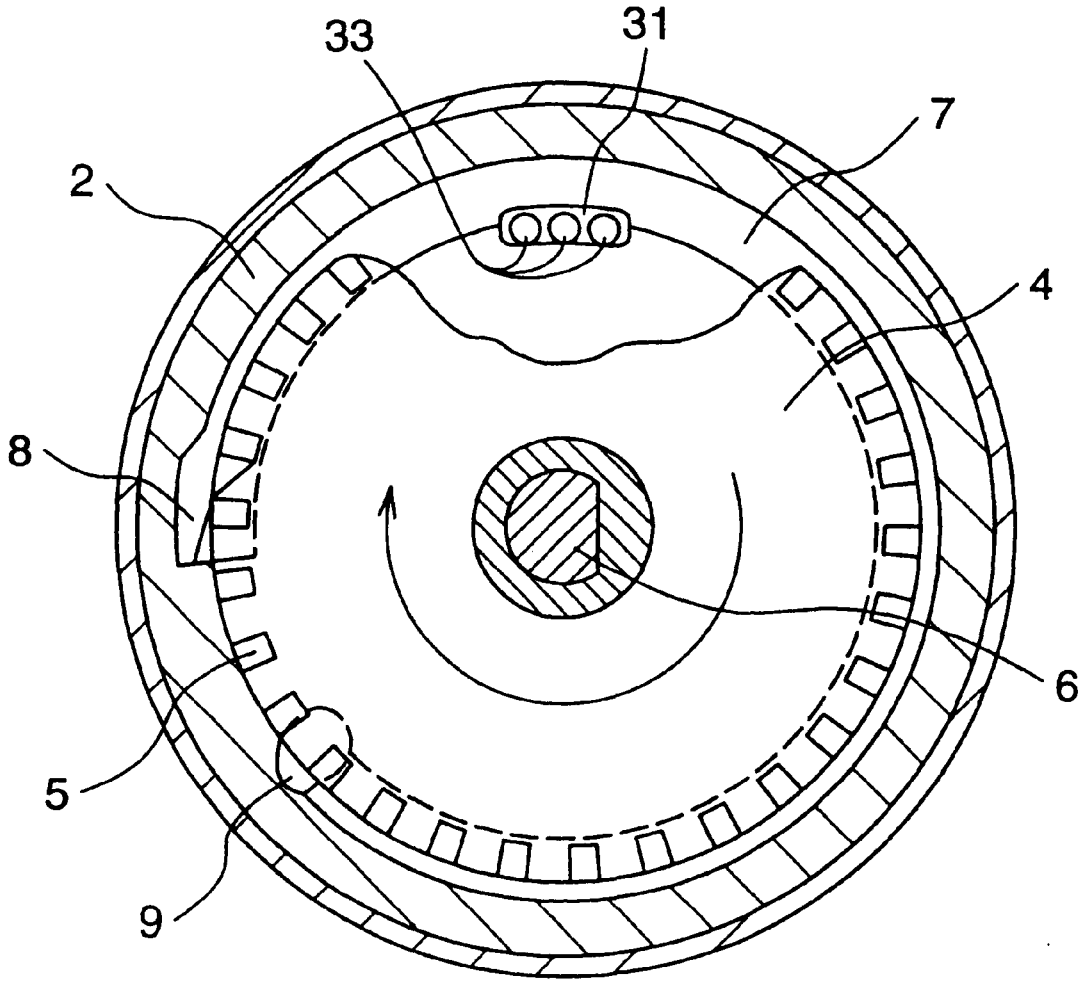
FIG. 4 is a sectional view of the pump casing assembly showing the circumferential liquid pump of the second embodiment of the present invention.

FIG. 4 is a sectional view of the pump casing assembly showing the circumferential liquid pump of the second embodiment of the present invention. In the figures, 2, 4–9 are the components similar to those of the above-described conventional device, so that their explanation will be omitted.

While the through hole 32 in the above first embodiment is arranged to be in an elongated circular configuration extending circumferentially along the afore-mentioned pump flow path 7, in the second embodiment, a plurality of through holes 33 are arranged within a partial annular ring shape extending circumferentially along the pump flow path 7. With such construction, a similar function to that of the first embodiment can be achieved.

Figure 5:
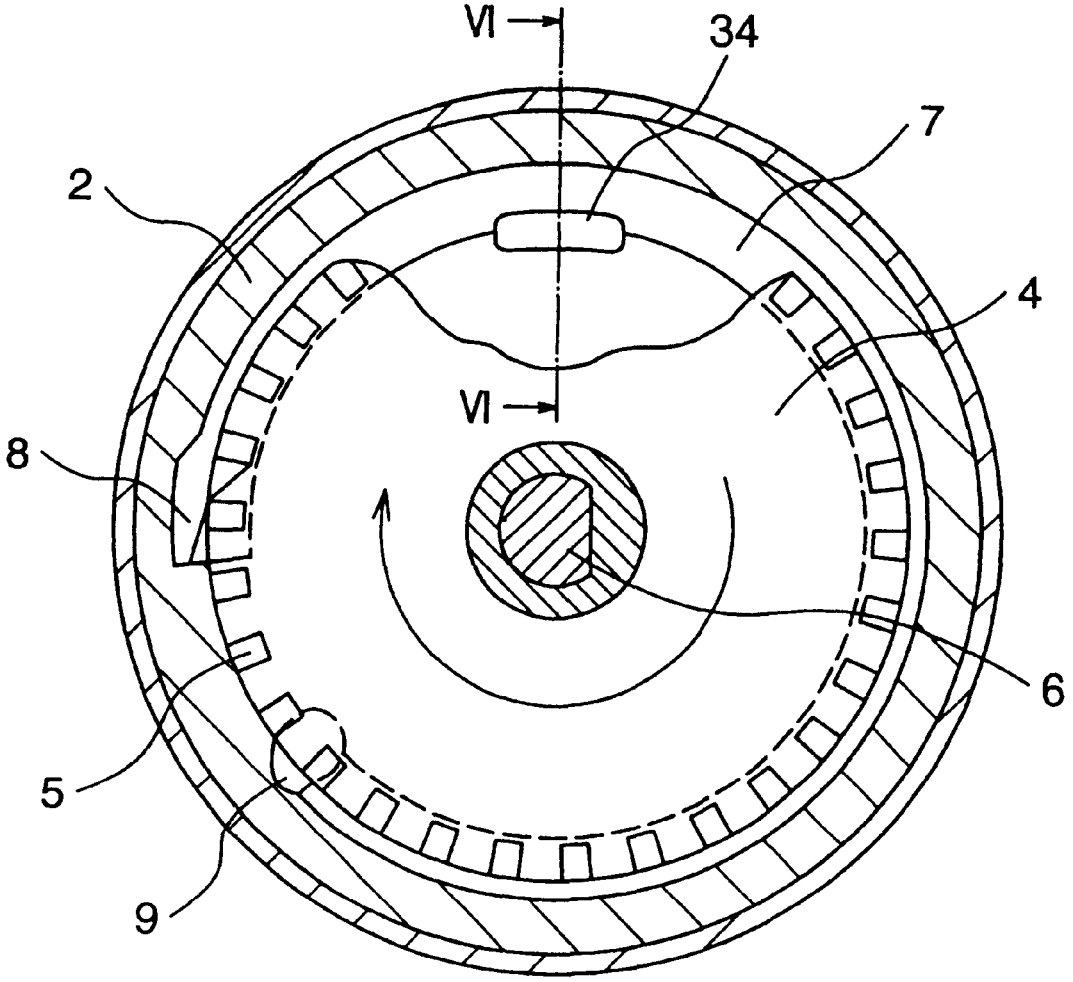
FIG. 5 is a sectional view of the pump casing assembly showing the circumferential liquid pump of the third embodiment of the present invention.
Figure 6:
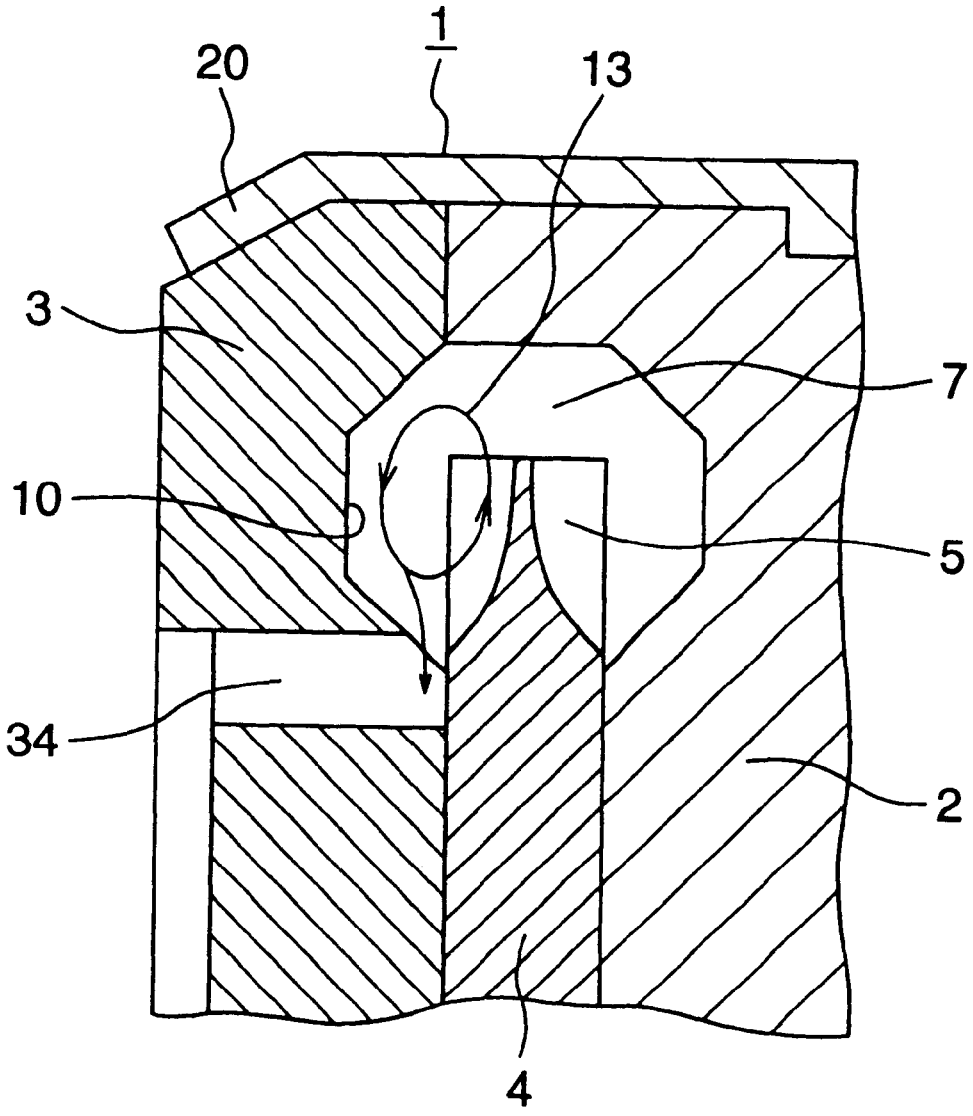
FIG. 6 is an enlarged sectional view taken along line VI—VI of FIG. 5.
Figure 7:
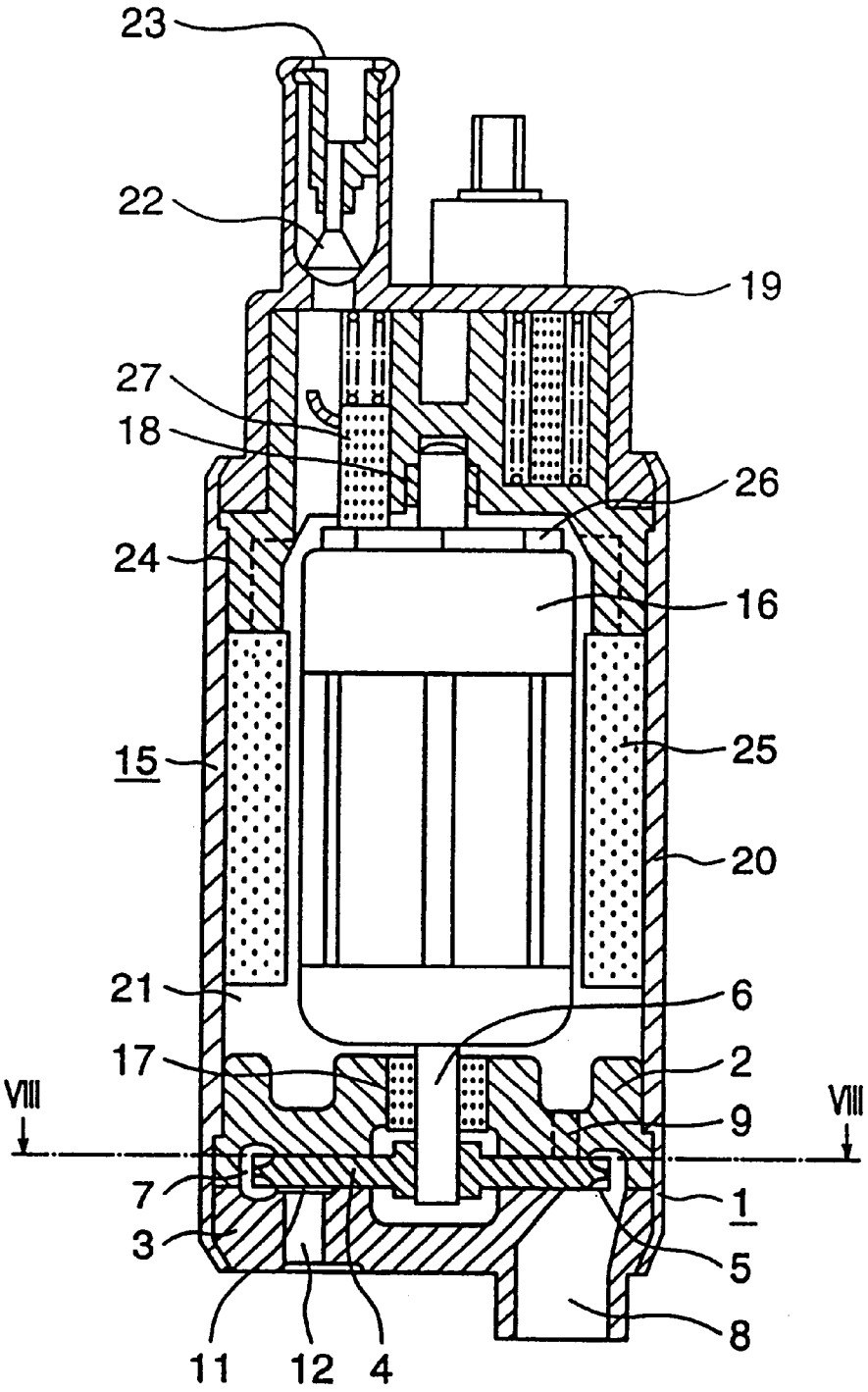
FIG. 7 PRIOR ART
FIG. 7 is a longitudinal sectional view showing a conventional circumferential flow liquid pump.
Figure 8:
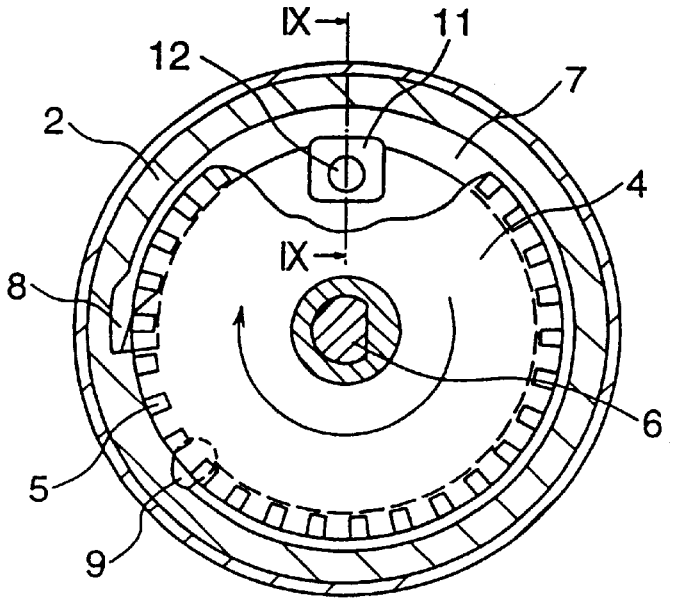
FIG. 8 PRIOR ART
FIG. 8 is an enlarged sectional view taken along line VIII—VIII of FIG. 7.
Figure 9:
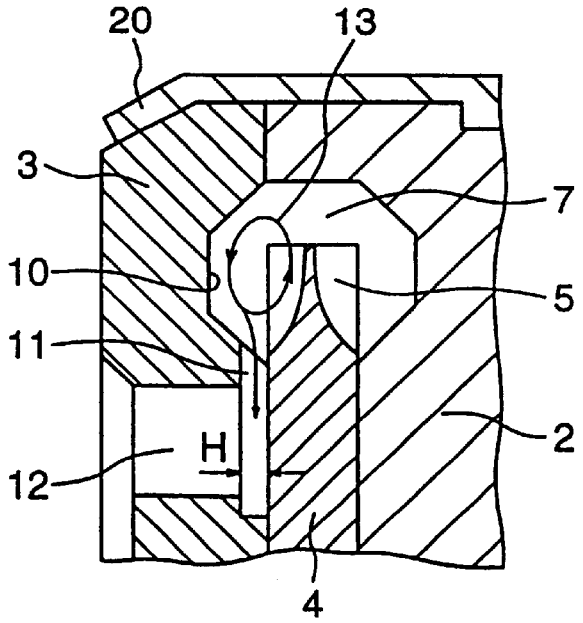
FIG. 9 PRIOR ART
FIG. 9 is an enlarged sectional view taken along line IX—IX of FIG. 8.

FIG. 5 is a sectional view of the pump casing assembly showing the circumferential liquid pump of the third embodiment of the present invention. FIG. 6 is an enlarged sectional view taken along line VI—VI of FIG. 5. In the FIGS. 1—10, 13, 20 are the components similar to those of the above-described conventional device, so that their explanation will be omitted.

The air vent hole in this embodiment is a through hole 34, which, as shown in FIG. 6, opens in the vicinity of the impeller 4 in the inner circumferential portion of the pump flow path 7 of the cover 3 with a raised step from the bottom portion 10 of the pump flow path 7 and extends directly therefrom in the axial direction to communicate the pump flow path 7 and the exterior of the pump casing assembly 1. Also, the cross-sectional configuration of the through hole 34 is as shown in FIG. 5. is a partial annular ring shape or an elongated circular shape extending along the pump flow path 7 and has a sufficiently large cross-sectional area.

Also in this embodiment, the cross-sectional area of the through hole 34 depends upon the size of the pump. For a typical passenger car, the through hole 34 has an elongated circular cross-sectional shape having a larger diameter of 4 mm and a smaller diameter of 1 mm, for example.

Also with such the arrangement, a similar function to that of the first embodiment can be achieved.

APPLICABILITY IN INDUSTRY

The circumferential flow liquid pump of the present invention has the structure as above described, so that the gas generated within the pump flow path is discharged to the exterior of the pump casing assembly without being affected by the flow path resistance. Therefore, the discharge of gas generated within the pump flow path to the exterior of the pump casing assembly can be achieved at a high efficiency and reliability, whereby the building up of the gas in the pump flow path and the generation of the vapor lock can be suppressed and the decrease of the pump discharge rate can be minimized.

What is claimed is:

1. A circumferential flow liquid pump comprising:

an impeller having an outer circumferential portion in which a vane portion is provided;

a pump casing assembly rotatably supporting said impeller, said pump casing defining (1) a pump flow path having an arcuate band-like shape extending along said outer circumferential portion of said impeller and (2) a suction port and a discharge port that respectively open at opposite end portions of said pump flow path; and an air vent hole defined in said pump casing assembly, said air vent hole having (1) a first end that opens to an inner circumferential portion of said pump flow path at a position radially inwardly spaced from a bottom portion of said pump flow path, and (2) a second end that opens to the exterior of said pump casing assembly at a position radially inward of said first end;

wherein said air vent hole has a cross-sectional configuration that (1) extends along said pump flow path, (2) defines a longitudinal axis that is parallel to a longitudinal axis of said pump flow path along an entire length of said cross-sectional configuration, and (3) is spaced apart from said suction port and said discharge port.

2. A circumferential flow liquid pump as claimed in claim 1, wherein said air vent hole comprises (1) a radial passage extending from said first end in a radially inward direction and (2) an axial passage extending from said radial passage to said second end.

3. A circumferential flow liquid pump as claimed in claim 1, wherein said air vent hole comprises (1) a radial passage extending from said first end in a radially inward direction and (2) a plurality of axial passages extending from said radial passage to said second end.

4. A circumferential flow liquid pump as claimed in claim 1, wherein said air vent hole comprises an axial passage extending along only an axial direction from said first end to said second end.

5. A circumferential flow liquid pump comprising:

an impeller; and a pump casing rotatably supporting said impeller, said pump casing defining (1) a pump flow path extending along an outer circumference of said impeller, (2) a suction port and a discharge port that open into said pump flow path, and (3) a vent hole having a first end that opens into said pump flow path, and a second end that opens to the exterior of said pump casing;

wherein said vent hole has a cross-sectional configuration that (1) extends along said pump flow path, (2) defines a longitudinal axis that is parallel to a longitudinal axis of said pump flow path along an entire length of said cross-sectional configuration, and (3) is spaced apart from said suction port and said discharge port.

6. A circumferential flow liquid pump as claimed in claim 5, wherein said vent hole comprises (1) a radial passage extending from said first end in a radially inward direction and (2) an axial passage extending from said radial passage to said second end.

7. A circumferential flow liquid pump as claimed in claim 5, wherein said vent hole comprises (1) a radial passage extending from said first end in a radially inward direction and (2) a plurality of axial passages extending from said radial passage to said second end.

8. A circumferential flow liquid pump as claimed in claim 5, wherein said vent hole comprises an axial passage extending along only an axial direction from said first end to said second end.

* * * * *